United States Patent [19]

Greif

[11] 4,064,643

[45] Dec. 27, 1977

[54] UNDERPHONE INDEX

[76] Inventor: Francis Greif, 199 Sussex Gardens, London W.2, England

[21] Appl. No.: 671,954

[22] Filed: Mar. 30, 1976

[30] Foreign Application Priority Data

June 24, 1975 United Kingdom ..... 26806/75

[51] Int. Cl.[2] ..... G09F 11/30

[52] U.S. Cl. ..... 40/65; 40/336

[58] Field of Search ..... 40/78.5, 78, 336, 65, 40/79; 312/330, 330 SM, 18, 19

[56] References Cited

U.S. PATENT DOCUMENTS

| | | | |
|---|---|---|---|
| 3,167,371 | 1/1965 | Parcher et al. | 40/78.5 X |
| 3,276,155 | 10/1966 | Conia | 40/65 |
| 3,289,335 | 12/1966 | Neilsen | 40/78.5 X |
| 3,292,286 | 12/1966 | Baumer | 40/65 |
| 3,721,485 | 3/1973 | Berger | 40/336 X |

*Primary Examiner*—Russell R. Kinsey
*Assistant Examiner*—Wenceslao J. Contreras
*Attorney, Agent, or Firm*—Steinberg & Blake

[57] ABSTRACT

The invention concerns indexes of the type which are intended to be placed under a domestic telephone to provide a library of telephone numbers with easy access. The index has an outer housing with a slideable drawer which carries a stack of cards carrying the information, such as names, addresses and telephone numbers. The tray has a series of manual selection members, which are each engageable with a perforated tab on an associated card of the stack, irrespective of the position on the stack of that card. The selection members comprise bell cranks and magnetic means hold all cards other than that selected within the housing.

9 Claims, 3 Drawing Figures

Figure 3:
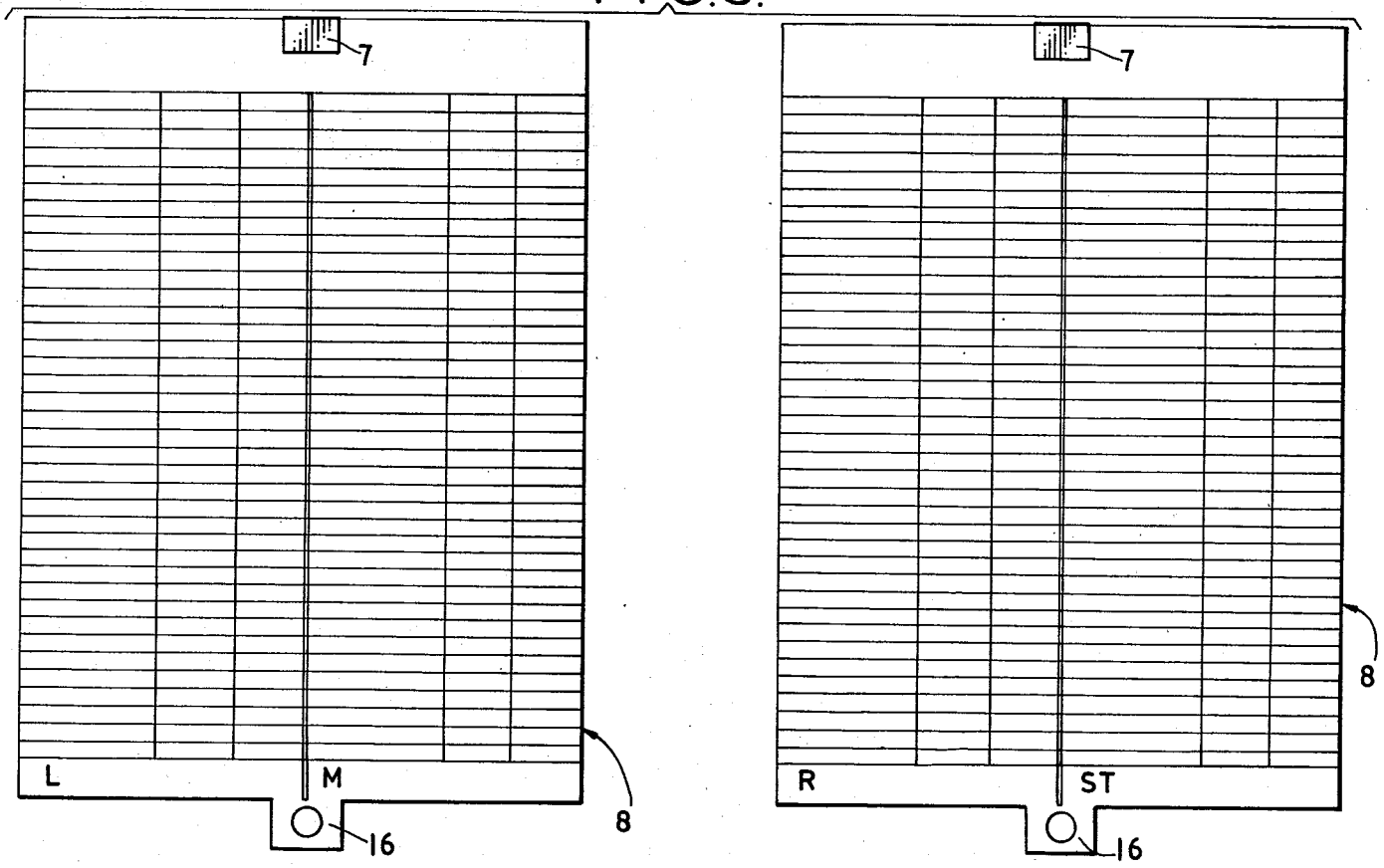

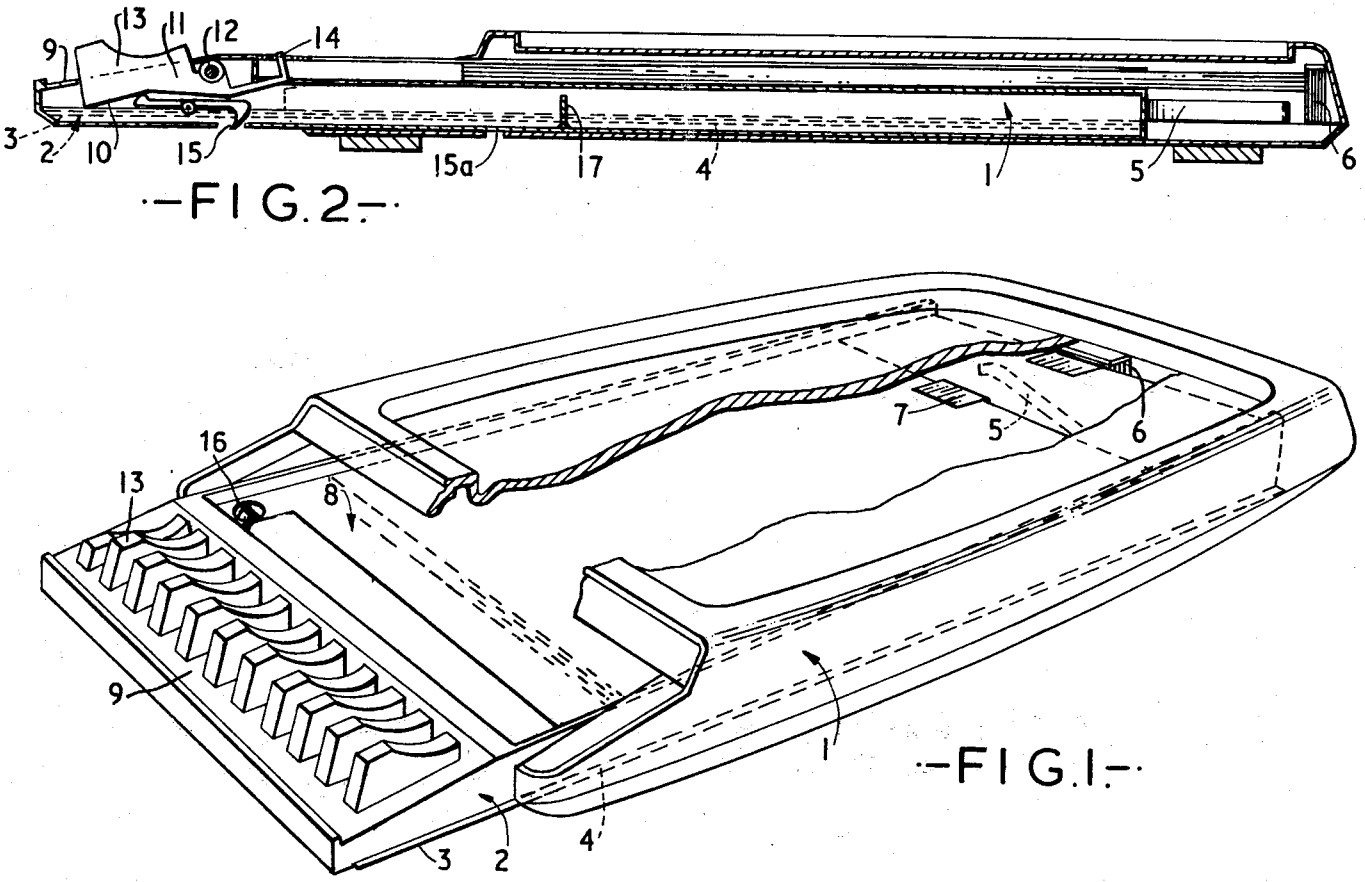
-FIG. 1-
-FIG. 2-

UNDERPHONE INDEX

PRIOR APPLICATION

In Great Britain on 24th June 1975 and numbered 26806/75.

The present invention relates to an index of the type that is intended to be placed under a telephone to provide easy access to a library of telephone numbers. Such an index will be referred to hereinafter for convenience as an under-phone index.

An under-phone index is known which comprises an outer housing which has a tray for reference cards slideably mounted therein. The tray houses a stacked plurality of reference cards which, in use, bear information such as the names, addresses and telephone numbers of subscribers. Each card has an associated selection member which is operated by a user to select a card, the tray being withdrawn from the outer housing along with the selected card and any others below it, but those cards above the selected card being retained by magnetic attraction inside the housing.

This arrangement suffers from the major disadvantage that, to achieve the stated object of providing for the cards above the selected cards to be retained by magnetic attraction inside the housing, it is necessary to provide each of the cards with an individual means for engaging its associated selection member, and to stack the cards in a predetermined order. Generally, each card in the stack is provided along one edge with one extra perforated tag area with respect to the next adjacent card.

Another generally similar index is known in which the cards are provided along one edge with aligned holes for engagement with selection lever ends, the holes being in a number increasing from top to bottom in the stack from one card to the other. In this way, each selection lever engages on actuation in the holes positioned in those cards corresponding to that particular selection lever, while the remaining cards are raised. The index outer housing has, near its open end, rearwardly directed inner stops. On outward movement of the card tray, the raised cards are caught by the stops and thereby prevented from being pulled out. As will be evident, it is again necessary for the cards to be stacked in a predetermined order for the device to operate as intended.

Other modified, and often more complicated, designs have been proposed.

It is accordingly an object of the invention to provide an improved, constructionally simple under-phone index in which it is not necessary to stack the cards in a predetermined order in the tray and in which a selected card may be withdrawn on its own from the stack, irrespective of the position in the stack of that card.

According to the present invention, there is provided an index (as defined herein) comprising an outer housing adapted to stand beneath a telephone and an inner housing in the form of a tray slideably mounted within the said outer housing, a plurality of superposed cards being provided in said tray for bearing information such as names, addresses and telephone numbers of telephone subscribers, each card having a perforated tab in a different position and each card having associated therewith a manually operable card selection member on the tray comprising a tab lever of which a part is movable up into engagement with the tab perforation of its associated card, to withdraw only the selected card from the stack, when the tray is withdrawn from the housing, irrespective of the position of the card in the stack, and to leave all the other cards of the stack retained by magnetic attraction inside the said outer housing.

Advantageously, each card of the stack carries a metal member or magnet at one end which is magnetically attracted to a magnet or metal member provided within the outer housing. Advantageously also, the tray which slides in the outer housing is spring-biassed into a withdrawn, open or extended position but is prevented from completely leaving the outer housing by fixed stop means. Conveniently, further stop means are provided to retain the tray in a closed position inside the outer housing, prior to tray withdrawal, said further stop means being automatically releasable by operation of any said card selection member. In this way, operation of a selection member to select its associated card automatically causes spring-biassed withdrawal of the tray from the outer housing, thereby to expose at least the majority of the surface area of the said selected card.

According to a preferred feature of the invention, the cards are formed of laminated material and are each provided at the end opposite the metal member or magnet with a said perforated tab. In accordance with a highly preferred embodiment of the invention, the perforated tab on each card is of the same size and shape as its neighbour but is disposed at a different distance along the edge of the card to provide a staggered series of tabs adjacent each other along one edge. Because the tab of each card is staggered with respect to the tag of every other card, no two tabs overlie each other and thus the superposed stack of cards will present the same row of discrete perforated tabs irrespective of the order in which they are stacked. It follows that the associated selection members, which are hook members on levers dimensioned to extend through the perforations of the tabs, can be relied on to engage only the tabs of their associated and intended cards and so each withdraw only its associated and intended card, irrespective of where the said card lies in the stack.

Advantageously, the cards are printed on one or both sides with a ruled layout for the insertion by a telephone subscriber of any desired information.

Advantageously also, the upper surface of the outer housing is provided with a moulded depression matched in shape to receive the base of a domestic telephone.

In order that the invention may be more readily understood, reference will now be made to the accompanying drawings which are given by way of example, and in which:

FIG. 1 shows in generally perspective view an under-phone index according to the present invention, FIG. 2 shows the index of FIG. 1 in sectional view, and FIG. 3 shows details of cards usable in the index.

As shown in FIG. 1, the index comprises an outer housing 1 in which an inner housing 2 in the form of a tray is slideable. Any convenient slide guide means are provided, such as a ridge 3 formed on the tray 2 and engageable in a slot 4 formed in the outer housing 1. Spring means 5 biasses the tray 2 into a position in which it is withdrawn from the outer housing 1, the illustrated embodiment being shown only partly withdrawn.

A magnet 6 of any suitable type is secured at the interior rear of the outer housing 1 and serves to attract metal members 7 secured to a rear edge of each of a superposed stack of index cards 8 housed within the suitably shaped interior of the tray 2.

The tray 2 carries at its front end a facing plate 9 which overlies a recess 10 in which there are provided a series of selection members. Any suitable number of (e.g. eleven) bell crank levers 11 are pivoted on a central rod 12 and each is provided with a finger moulded operative portion 13 and an upwardly directed, pointed hook arm 14. Depression of any lever portion 13 causes a corresponding upward movement of the associated hook 14. Simultaneously, such depression causes depression also of one end of a pivoted latch 15, which latch in a position of rest engages a recess 15*a* in the housing 1 base and thereby serves as a releasable stop means to hold the tray 2 inside the housing 1 against the action of the spring 5.

As shown in FIG. 3, each of the cards 8 carries at its edge opposite the metal member 7 a similarly dimensioned perforated tag 16. But each card of the stack has its tab 16 laterally displaced one way or the other along the edge of the card with respect to all the other cards of the stack. Thus irrespective of the order in which the cards are stacked, there will be presented always the same staggered series of tabs 16 along one edge of the stack. It follows that when the stack of cards is loaded into the tray 2, each hook 14 is engageable with only one perforated tab 16.

In use, an operator depresses the member portion 13 corresponding to that card which he wishes to display, and in so doing releases the stop 15 to enable the spring 5 to urge withdrawal of the housing 2 from the housing 1. Undesirable complete withdrawal (i.e. ejection of the tray 2 from the housing 1) is prevented by any suitable permanent stop means such as shown schematically at 17. As the hook member 14 associated with the depressed selection member rises due to pivoting action around the rod 12, it engages the tab 16 of the associated card 8 and withdraws only that card from the stack, leaving the remainder of the cards held by magnetic attraction inside the outer housing 1. Thus, only the selected card is displayed, irrespective of the order in which the cards have been loaded into the tray 2.

When the tray 2 is pushed back into the housing 1 against the action of the spring 5 by the operator, the hook 15 latches in its engagement recess 15*a* in the base of the outer housing 1 to secure the index in the closed position.

Advantageously at least the major parts of the index are formed from plastics material and the upper surface of the housing 1 is formed with a recess of shape suitable to receive the base of a standard domestic telephone.

It will be noted that the several cards 8 are each uncovered and freely accessible particularly at the front end thereof where the perforated tab is situated, when the tray is in the withdrawn, open and extended position shown in FIG. 1. Thus, not only is the selected card moved forwardly with the tray to the open extended position of the latter shown in FIG. 1, but in addition this card can simply be raised and removed from the remaining cards which are held back by the magnetic means to have information removed or introduced thereon and then replaced in the stack in a highly convenient manner. Thus it is a highly advantageous feature of the invention to provide in this simple way the possibility of removing any selected card from the stack so as to have additional information placed on the card.

I claim:

1. An index of the type herein defined comprising an outer housing adapted to stand beneath a telephone; an inner housing in the form of a tray slideably mounted within the said outer housing for movement with respect thereto between an inner retracted position where only a front portion of said tray is exposed and freely accessible and an outer withdrawn position where said tray extends through a substantial distance forwardly beyond said housing with only an inner rear portion of the tray remaining in engagement with said housing; a plurality of superposed cards for bearing information such as names, addresses and telephone numbers of telephone subscribers; magnetic means on the cards and housing to provide mutual attraction therebetween; and a plurality of manually operable card selection members provided on the tray; wherein each said cards has at a front end a perforated tab in a different position from the tabs of the other cards and each said card selection member comprises a lever of which a front exposed part is situated at and freely accessible at the front portion of the tray, forwardly beyond said tabs while a rear part is situated beneath and movable up into engagement with the tab perforation of its associated card of the said plurality of cards to withdraw only the selected card from the stack when the front part of the lever is depressed to displace the rear part of the lever up into engagement with a tab perforation and the tray is withdrawn from the housing, irrespective of the position of said card in the stack, and to leave all the other cards of the stack retained by magnetic attraction inside the said outer housing, all of the structure of said tray and all of the structure of said plurality of manually operable card selection members being situated beyond a space over said plurality of superposed cards, including said perforated tabs at said front ends thereof, so that said cards are carried by said tray with said front end of each card uncovered and freely accessible when the tray is moved with respect to said outer housing to a withdrawn, open and extended position so that any card can be conveniently removed and replaced for the purpose of changing or adding information on the card.

2. An index as defined in claim 1, wherein each said card of the said stack carries a metal member at one end which is magnetically attracted to a magnet provided within the outer housing.

3. An index as defined in claim 1, wherein each said card of the said stack carries a magnet at one end which is magnetically attracted to a metal member provided within the outer housing.

4. An index as defined in claim 1, wherein spring biassing means are provided within the said housing, said spring means biassing the slideable tray into said withdrawn, open and extended position, the housing and tray being further provided with inter-engageable fixed stop means to prevent the said tray completely leaving the said housing.

5. An index as defined in claim 1, wherein releasable stop means are provided to retain the tray in a closed position inside the outer housing, said stop means being automatically releasable by operation of any one of said plurality of card selection members.

6. An index as defined in claim 5, wherein the releasable stop means comprises a pivotal stop member on the tray engageable with a recess in the outer housing and movable out of said engagement by operation of any said card selection member.

7. An index as defined in claim 1, wherein the cards are formed from laminated material and the perforated tab on each card is of the same size and shape as its neighbour but disposed at a different distance along one card edge, whereby the superposed stack of cards displays a staggered series of similar discrete perforated tabs adjacent each other along said one edge.

8. An index as defined in claim 1, wherein the upper surface of the said outer housing is provided with a moulded depression matched in shape to the base of a domestic telephone.

9. An index as defined in claim 6, wherein said pivotal stop member extends beneath said front portions of said levers to be operated upon depression of said front portion of a selected lever.

* * * * *